United States Patent [19]

Vuorela

[11] Patent Number: 4,759,773

[45] Date of Patent: Jul. 26, 1988

[54] METHOD OF PREVENTING ENERGY LOSS, SELF-HEATING AND SELF-IGNITION IN PEAT STACKS

[75] Inventor: Antti Vuorela, Oulu, Finland

[73] Assignee: A. Jalander Oy, Oulu, Finland

[21] Appl. No.: 23,331

[22] Filed: Mar. 9, 1987

[30] Foreign Application Priority Data

Mar. 10, 1986 [FI] Finland ..... 860990

[51] Int. Cl.[4] ..... C10L 5/44; E21C 49/00

[52] U.S. Cl. ..... 44/27

[58] Field of Search ..... 44/1 R, 6, 1 G, 27, 44/33

[56] References Cited

U.S. PATENT DOCUMENTS

| | | | |
|---|---|---|---|
| 1,393,435 | 10/1921 | Dow | 44/27 |
| 2,204,781 | 6/1940 | Wattles | 44/6 |
| 4,482,351 | 11/1984 | Kitazawa et al. | 44/1 R |
| 4,518,393 | 5/1985 | Pace et al. | 44/1 R |
| 4,650,495 | 3/1987 | Yan | 44/1 G |

FOREIGN PATENT DOCUMENTS

| | | | |
|---|---|---|---|
| 1134398 | 10/1982 | Canada | 44/27 |
| 740806 | 10/1943 | Fed. Rep. of Germany . | |
| 964759 | 5/1957 | Fed. Rep. of Germany . | |
| 175978 | 6/1923 | United Kingdom | 44/27 |
| 380837 | 5/1973 | U.S.S.R. . | |
| 400706 | 10/1973 | U.S.S.R. . | |
| 735780 | 5/1980 | U.S.S.R. . | |

*Primary Examiner*—Carl F. Dees

*Attorney, Agent, or Firm*—Pennie & Edmonds

[57] ABSTRACT

The invention relates to a method of preventing the energy loss, self-heating and self-ignition of a peat stack. The rick storage of peat is often connected with a heating caused by exothermal reactions, which causes energy losses of the peat and even self-ignition. This problem has been solved by conducting inert protective gas into the stack, by which the air present in the stack is displaced or diluted and thus the aerobic exothermal reactions of the peat are prevented. It is preferable to insert inert protective gas in a liquid state into a stack heated up to critical point or into the heat centre of it, the gas rapidly cooling the stack or the centre and thus preventing even more efficiently the ignition of a stack fire. Covering the stack with a cover like a plastic foil considerably prolongs the presence of the inert-gas in the stack and thus improves the effect of the inert-gas treatment.

14 Claims, 4 Drawing Sheets

TUBE DIAGRAM OF A GASSED STACK

1. ST LEVEL

2. ND LEVEL

3. RD LEVEL

4. TH LEVEL

Stack 1/1
$CO_2$ - stack
Temperature
C°
40
30
20
10
K 2
K 1
x K4
x K3
x K6,7
x K5
3.9
5.9
6.9
7.9
8.9
9.9
11.9
13.9
16.9
18.9
24.9
Date Stack 2/1

METHOD OF PREVENTING ENERGY LOSS, SELF-HEATING AND SELF-IGNITION IN PEAT STACKS

The invention relates to a method of preventing energy loss, self-heating and self-ignition in peat stacks, i.e. a method of conservation and fire-protection of peat stacks.

Rick storage is the most advantageous manner of conserving peat. However, the phenomenon of spontaneous combustion of the peat is nearly without exception connected with this storage. This exothermal reaction reduces the energy content of the peat and may also set fire to the peat stack. It has also been noted that the hudimity of the peat may accelerate this detrimental exothermal reaction. In rick storage of peat, the risks consist in the size and the shape of the stack, which allows local heat centres to arise, non-homogeneously distributed humidity, and fine stuff among the peat lumps, which usually is more humid than the lumps of peat. The problem of the present invention is consequently the heat produced by exothermal reaction in rick storage of peat, causing energy losses and self-ignition of the peat. An advanced state of overheating is hard to eliminate and a smouldering fire seat is difficult to extinguish.

Efforts to solve these problems have been made by reducing the amount of finely divided peat in the stack, which causes energy losses and self-ignition. Thus, the FI patent application 850 115 discloses a method of preventing self-ignition and dust explosion when handling pulverous peat fuels. The method consists in avoiding detrimental finely divided peat dust by flocculating it with a liquid or pulverous material. In the introduction of the SU patent specification No. 735 780 it is noted that the use of such substances to avoid the self-ignition of peat as formalin, chlorine picrine, trichlorethan, dichlorobenzene etc. is known. The stack has also been protected against humidity and the oxygen necessary for peat fire by covering it with a plastic foil (SU patent specification No. 380 837, Selezneva, G.V. et al., Torf. Prom. 1974 (2) 16–19, Power, J.D. Leningrad, Pro.Symp. IPS Comm. II, 27–29/8/74 10 pp., and Andrzheevsky, A.M. et al., Torf. Prom. 1970 (8) 5–8) or by producing an otherwise tight surface layer (SU patent specification 400 706, 735, 780 and 322 498).

The exothermal reaction, which is favoured a.o. by humidity, may be delayed in the peat stack e.g. by moisture insulating the bottom of the stack, by shaping the stack so as to prevent moisture and heat from remaining in the stack, or by improving the ventilation of the stack e.g. by using network sides and ventilation ducts. A self-heated stack may be cooled by moving it (Aaltonen, L., Marsh restoring, Peat production and storage, INSKO 77, 1974). When trying to seal a milled peat stack in order to minimize the heat producing reaction, the lumped peat has to be ventilated (Komonen, P. Peat ricking technique, INSKO 65, 1983). A direct fire hazard has been avoided by sealing the over-heated part, or in the worst case, by decomposing the stack with an excavator and by using plenty of water.

As it appears above, the protection of a peat stack against energy loss and self-ignition of the peat is an extremely difficult and sometimes even conflicting task, depending a.o. on the peat quality, the moisture and the amount of aeration. Thus, the methods of prior art have not efficiently succeeded in preventing energy losses nor the self-ignition of the peat. Toxicating microorganisms is expensive and dangerous to the environment and it does not prevent non-biological ignition. Preventig stack fires e. g. by continuously moving the stack is an extremely expensive, time-consuming and also uncertain operation. A stack in full blaze is very difficult to put out.

The purpose of the present invention is thus to produce a method, by which the above disadvantages can be eliminated.

The invention is then mainly characterized in that inert protective gas is conducted into the stack, thus displacing or diluting the air present in the stack, and preventing the aerobic exothermal reactions of the peat. By displacing the air with inert protective gas one achieves that the reactions requiring air and producing heat stop inside the stack and thus energy losses and hazardous self-heating of the peat in the stack are avoided. It is advantageous to insert inert protective gas in a liquid state into a stack or centre that is heated to a critical point. The air is then displaced and the part of the stack rapidly cooled, whereby the smouldering stops and the starting fire is prevented. The method is not expensive, since by one treatment in favourable conditions the heat producing reaction can be stopped or delayed for a very long period, even after the major part of the inert-gas has disappeared from the stack.

A protective gas method according to the invention may possibly be used in other fire protection applications of peat sites as well, the extinction water supply and inefficiency of the extinction often causing a problem. The use of protective gases may equally apply to the storage and fire protection of other problem products (like splint, wood chips, etc.).

The peat stacks used in the invention are ordinary stacks. If the peat contains a large amount of fine ingredients, the risk of energy loss, self-heating and self-ignition is higher and the need for inert gassing according to the invention is greater. Covering the stack with a coating like a plastic foil considerably prolongs the presence of inert-gas in the stack, and consequently, it is very advantageous for the invention to gas seal the stack.

By the inert-gas used in the method according to the invention is intended a gas that delays energy loss and self-heating. Since it has been observed that the energy loss and self-heating are produced by an aerobic activity requiring the presence of oxide, the inert gases used are usually oxygen-free and preferably nontoxic. Particularly advantageous are nitrogen and carbon dioxide gases. The inert protective gas may advantageously be inserted into the stack in a liquid state, whereby its evaporation energy may be utlized for reducing the temperature of the stack, which is necessary particularly when there is a risk of the heating leading to self-ignition.

The feeding of the inert-gas according to the invention may be carried out in several manners. As inert-gas is inserted according to one embodiment into the just prepared covered or uncovered stack, the gas prevents in advance the energy loss or the self-ignition. According to another embodiment, the inert-gas is not fed into the finished covered or uncovered stack until the stage where signs of heating are observed in the stack. According to a third embodiment, liquid inert protective gas is inserted into the stack heated up to a critical point or into a heat centre of it. A fast cooling of the part and displacing of the air stops the smouldering and the beginning stack fire is prevented.

The conveying and feeding equipment of the inert-gas is an ordinary gas treating equipment. Although the inert-gas fills up the entire stack space in a relatively short period, its spreading may be advantageously speeded up by inserting the gas through several evenly distributed points in the stack, like one or several perforated tubes.

EXAMPLES

Some embodiment examples of the present invention are described below. In the first example, carbon dioxide was fed into the unheated stack covered with a plastic foil, and the evolution of the gas composition and the temperature was observed as a function of time. In the second example, liquid nitrogen was added in several steps into an initially uncovered and already hot stack and the temperature evolution was observed as a function of time. The stack was subsequently covered up with a plastic foil, liquid nitrogen was added, and the temperature evolution was again observed as a function of time. In the third example liquid nitrogen was inserted into a heated stack covered with plastic, and the temperature evolution was observed as a function of time.

Figure 1:
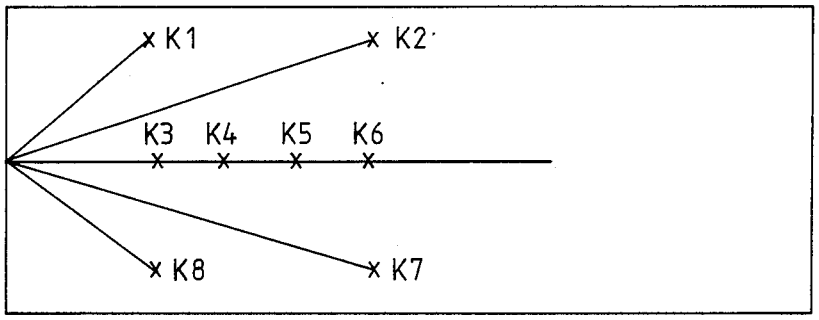
FIG. 1 represents a stack according to one embodiment of the invention and the feeding device for inert-gas disposed into it, as well as the points of gas sampling and temperature measurement used in the tests.
Figure 1:
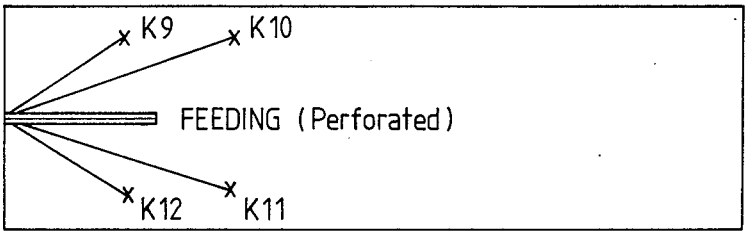
Figure 1:
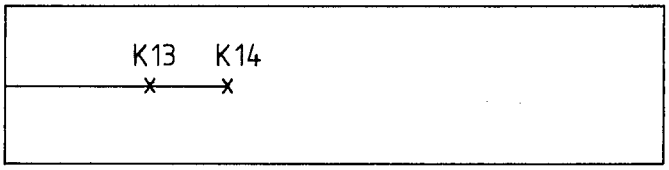
Figure 1:
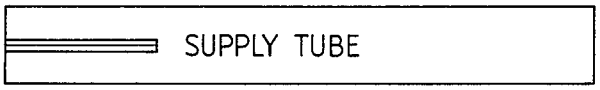
Figure 1:
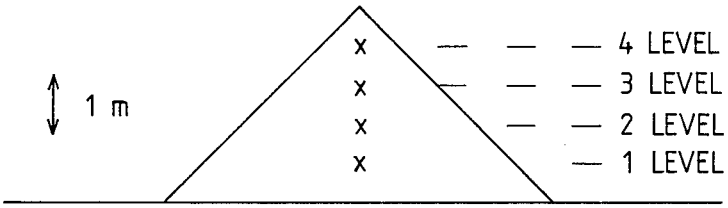

The examined stacks were prepared in connection with a normal lump peat production. The peat was a far decomposed sedgy peat, and thus the lump size was small and the fine stuff was relatively abundant. In other words it was a peat capable of spontaneous combustion when stored in stacks. Stacks comprising 500–1000 $m^3$ of peat were prepared for the tests. The stacks were raised in several stages, as gassing, sampling and measuring tubes were inserted into them. The typical shape of the stack and the emplacement of the tubes appear from FIG. 1.

EXAMPLE 1

In the first test the change of the gas composition produced by the carbon dioxide fed into the stack was tested in various parts of the stack and the duration of the change as well as the influence of this operation on the stack temperature was tested. The $CO_2$ gas was delivered in a portable container and was fed into the rear end of the stack and simultaneously an outlet had been made in the other end, i.e. in the plastic foil, to assure the outflow. The stack was prepared on Aug. 6, 1985 and the inert-gas was inserted on Aug. 7 and 8, in an amount of gas of 2060 kg, so that no spontaneous combustion of the stack was allowed to take place. The measurements were immediately begun and their results are presented in table I.

Figure 2:
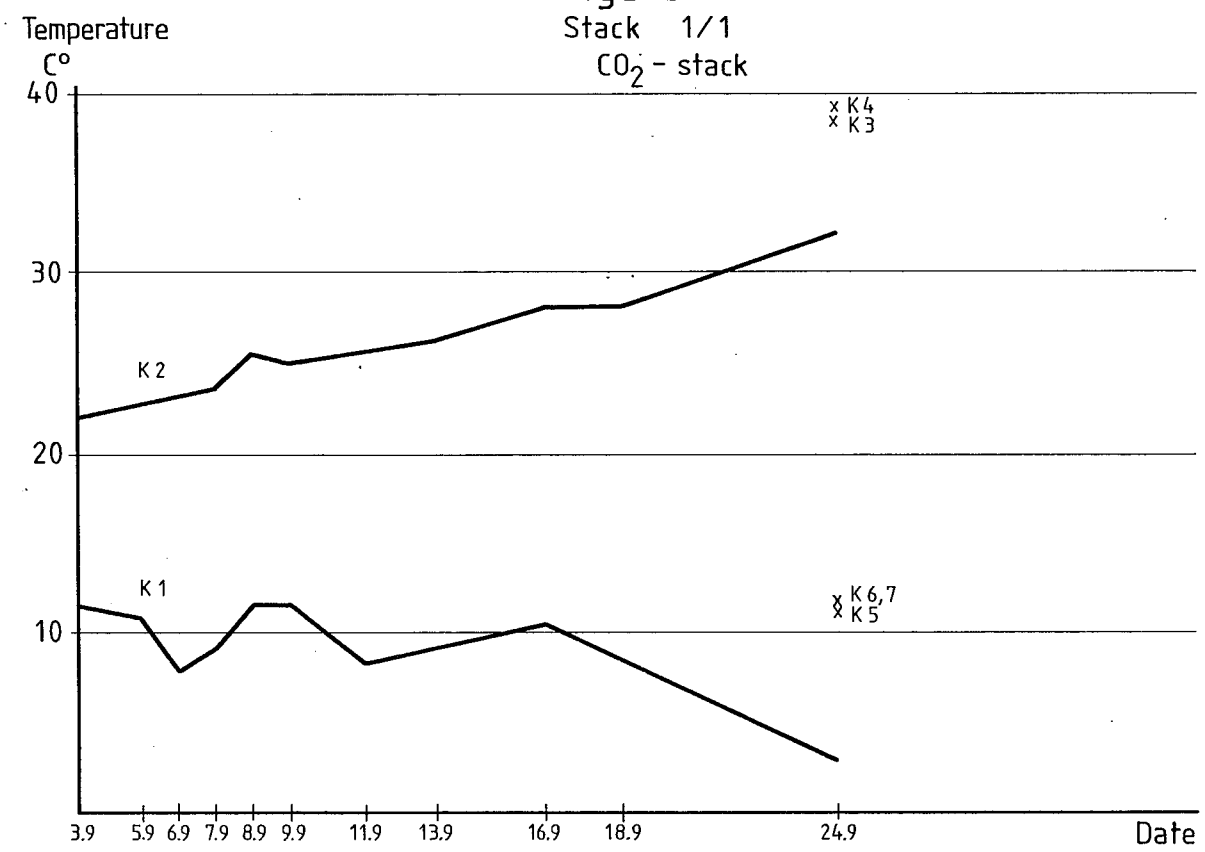
FIG. 2 represents the temperatures of an initially cool stack treated with carbon dixoide according to the first embodiment example (cf. below) at various points of measurement as a function of time and measured during September.

The carbon dioxide inserted was relatively homogeneously distributed into the stack, esepcially below the feeding point. After a week the $CO_2$ concentration was about 50—50% at the level of 1 m, and 45% at a higher level, in three weeks the rate sank to about 12%. After one and a half month, the composition of the gas present in the stack corresponded to the one of a gas in an untreated stack. The temperature evolution of the stack is represented in FIG. 2. The temperature remained very stable during the entire follow-up period starting from Sept. 3, 1985 and the raise was slow. The highest reading observed was 39, 1° C., measured on Sept. 24, and consequently no risk of ignition has been allowed.

CHART I

Evolution of the gas composition of a peat stack covered with a plastic foil as a function of time after the carbon dioxide treatment according to example 1.

| Date/hours | Sample no. | Temperature °C. | $O_2$ Vol. % | $N_2$ Vol. % | $CO_2$ Vol. % |
|---|---|---|---|---|---|
| 9.8.85/08.30 | 6 | | 2.5 | 10.8 | 86.7 |
| 9.8.85/11.30 | 6 | | 2.3 | 12.0 | 85.7 |
| 8.8.85/17.00 | 10 | | 1.9 | 8.7 | 89.4 |
| 9.8.85/08.30 | 10 | | 3.0 | 13.1 | 83.9 |
| 9.8.85/11.30 | 10 | | 3.8 | 15.9 | 80.3 |
| 9.8.85/11.30 | 14 | | 7.1 | 30.2 | 62.7 |
| 9.8.85/08.38 | 14 | | 6.9 | 30.2 | 62.9 |
| 8.8.85/17.00 | 14 | | 5.8 | 29.0 | 65.2 |
| 12.8.85/15.00 | 3 | | 6.9 | 42.2 | 50.9 |
| 12.8.85/15.00 | 6 | | 7.2 | 42.1 | 50.7 |
| 12.8.85/15.00 | 14 | | 9.3 | 46.1 | 44.6 |
| 14.8.85/14.00 | 2 | 13.5 | 6.3 | 41.1 | 52.6 |
| 14.8.85/14.00 | 7 | 13.5 | 6.3 | 42.3 | 51.4 |
| 14.8.85/14.00 | Rear end | 13.5 | 7.1 | 43.0 | 49.9 |
| 16.8.85/13.00 | 1 | 15.1 | 6.4 | 42.4 | 51.2 |
| 16.8.85/13.00 | 8 | 15.1 | 5.2 | 43.3 | 51.5 |
| 16.8.85/13.00 | Rear end | 15.1 | 5.6 | 43.7 | 50.7 |
| 19.8.85/12.30 | 3 | 12 | 5.7 | 45.1 | 49.2 |
| 19.8.85/12.30 | 10 | 12 | 7.6 | 45.3 | 47.1 |
| 19.8.85/12.30 | Rear end | 12 | 5.5 | 45.1 | 49.4 |
| 23.8.85/12.30 | 9 | | 13.4 | 78.6 | 8.00 |
| 23.8.85/12.30 | 12 | | 12.32 | 78.01 | 9.67 |
| 23.8.85/12.30 | 13 | | 11.76 | 79.43 | 8.81 |
| 23.8.85/12.30 | Rear end | | 14.31 | 76.78 | 8.91 |
| 27.8.85/08.30 | 11 | 11.5 | 8.0 | 59.46 | 32.5 |
| 27.8.85/08.30 | 14 | 11.5 | 8.3 | 68.5 | 23.2 |
| 27.8.85/08.30 | 5 | 11.5 | 4.2 | 39.2 | 56.6 |
| 27.8.85/08.30 | Rear end | 11.5 | 8.8 | 62.7 | 28.5 |
| 30.8.85/08.00 | Rear end | 11.5 | 8.3 | 78.3 | 13.4 |
| 30.8.85/08.00 | 3 | 11.5 | 11.3 | 76.7 | 12.8 |
| 30.8.85/08.00 | 1 | 11.5 | 12.2 | 76.2 | 11.6 |
| 30.8.85/08.00 | 8 | 11.5 | 12.0 | 76.4 | 11.6 |
| 16.9.85/09.00 | 2 | | 12.9 | 78.9 | 8.8 |
| 16.9.85/09.00 | 6 | | 12.8 | 78.0 | 9.2 |
| 16.9.85/09.00 | 7 | | 14.4 | 78.6 | 7.0 |
| 16.9.85/09.00 | Rear end | | 15.8 | 78.2 | 6.0 |
| 18.9.85 | 1 | | 12.9 | 77.9 | 9.2 |
| 18.9.85 | 2 | | 12.6 | 76.6 | 10.8 |
| 18.9.85 | 3 | | 15.0 | 77.6 | 7.4 |
| 18.9.85 | 5 | | 10.0 | 79.2 | 10.8 |
| 18.9.85 | 6 | | 10.9 | 79.1 | 10.0 |
| 18.9.85 | 7 | | 11.2 | 78.9 | 9.9 |
| 18.9.85 | 8 | | 14.3 | 78.3 | 7.4 |
| 18.9.85 | 9 | | 11.1 | 78.7 | 10.2 |
| 18.9.85 | 10 | | 14.0 | 78.2 | 7.8 |
| 18.9.85 | 11 | | 10.7 | 79.2 | 10.1 |
| 18.9.85 | 12 | | 15.0 | 78.1 | 6.9 |
| 18.9.85 | 13 | | 9.9 | 78.9 | 11.2 |
| 18.9.85 | 14 | | 9.7 | 79.0 | 11.3 |
| 18.9.85 | Rear end | | 6.8 | 80.7 | 12.5 |

EXAMPLE 2

Besides the storage study itself, cooling tests of the heated stacks were made by using liquid nitrogen. Cold liquid nitrogen was conducted into the stack through a metal tube inserted into the stack. The temperature variations caused by the liquid gas were observed by thermo-elements placed in the stack. The temperature of the stack may be considered to sink firstly because the heat present in the stack is consumed by the evaporation of the liquid nitrogen, and secondly because the nitrogen displaces the oxide and reduces the aerobic exothermal activity of microorganisms and thirdly because the spontaneously beginning combustion is extinguished.

Figure 3:
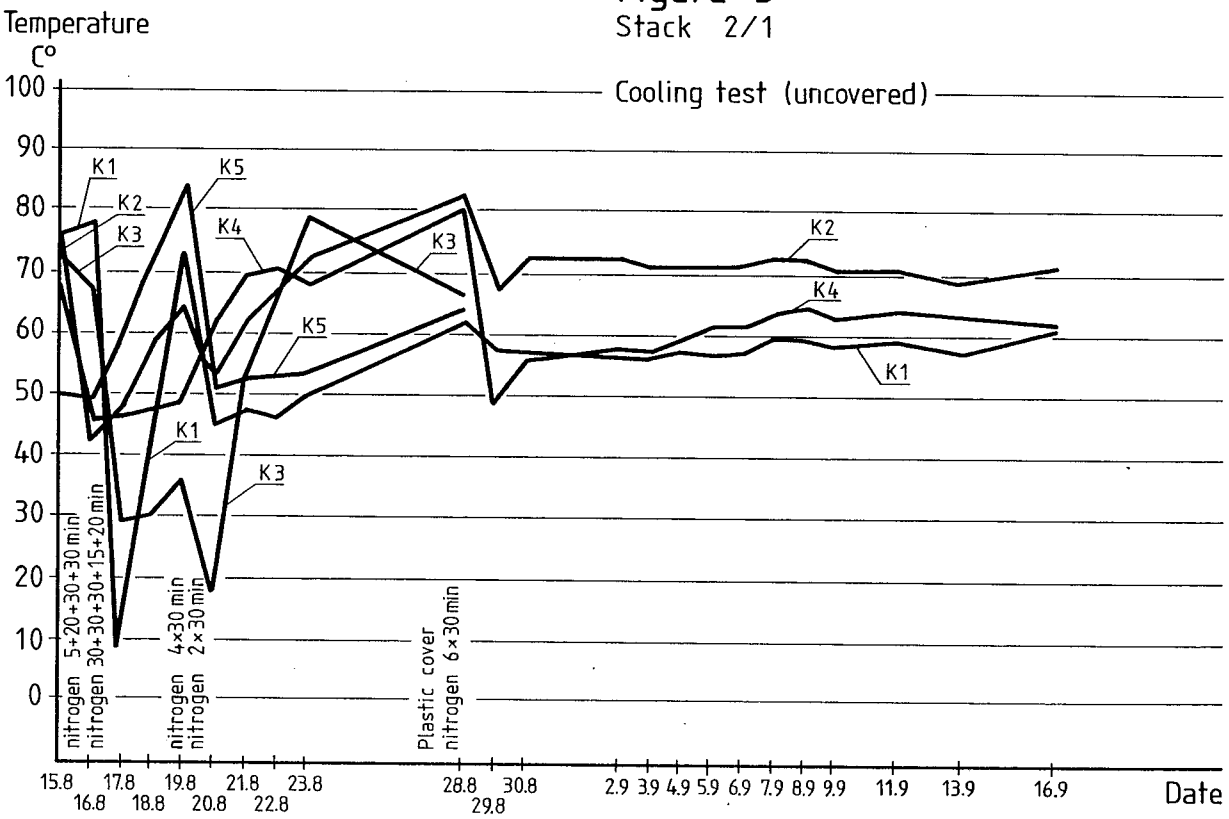
FIG. 3 represents the temperatures of an initally uncovered and hot stack at various points of measurement as a function of time, liquid nitrogen being added to the stack in several steps according to the second embodiment example, and finally the stack is covered with a plastic foil and is once more treated with liquid nitrogen.

In Example 2 a liquid nitrogen treatment was carried out several times on an uncovered stack having already begun to heat, after which the stack was covered with a plastic foil and was once more treated with liquid nitrogen. FIG. 3 represents the temperatures of various sections of a stack treated according to Example 2 as a function of time. the operations carried out on the stack are marked on the time-axis at the time when they were carried out.

The strong temperature reducing influence of the liquid nitrogen introduced into the uncovered stack in example 2 proved to be temporary. The temperature regained the initial level after 1–2 days and continued to raise. Under the influence of strong winds the gas composition of the stack apparently rapidly regained its initial state and the organism activity continued. Only by covering the stack with plastic and conducting nitrogen into the stack was the situation balanced. The temperature of the stack remained relatively high (60°–70° C.), but stopped rising entirely before the end of the measuring moment.

EXAMPLE 3

In this example the stack was also treated with liquid nitrogen. The liquid nitrogen was introduced into the stack through a metal tube inserted into the stack and the temperature variations caused by the liquid gas were registered by a thermo-element placed in the stack.

Figure 4:
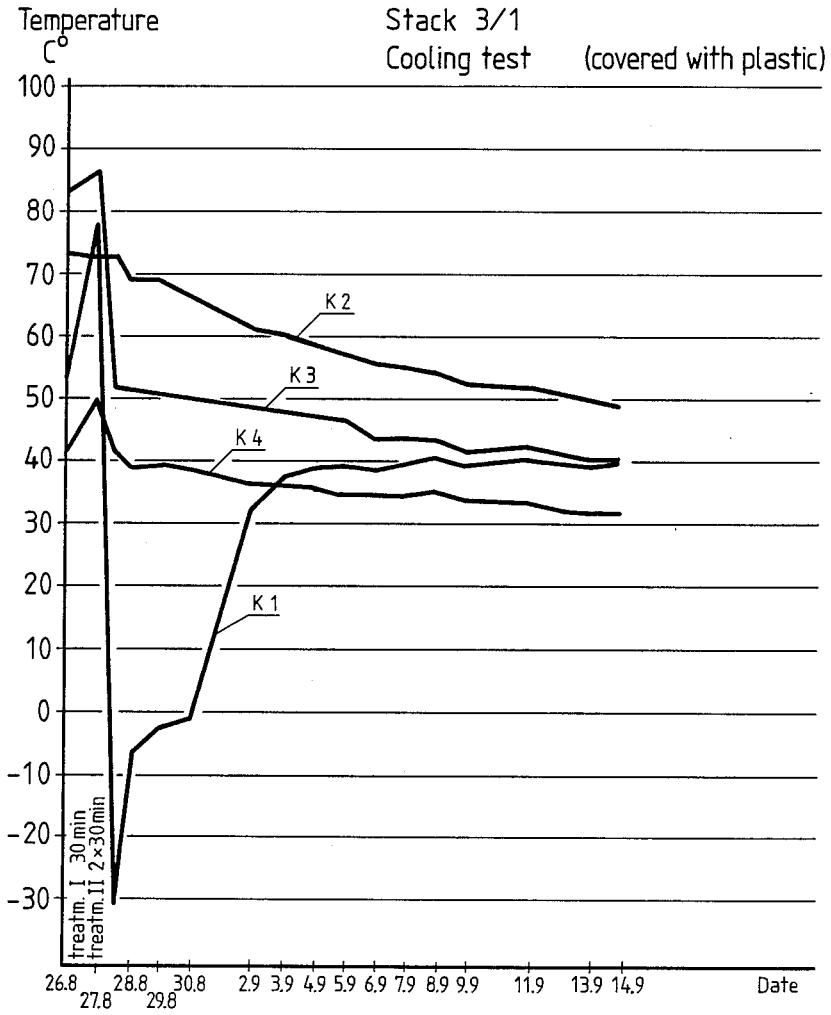
FIG. 4 represents the temperatures of an initally hot stack covered with plastic at various points of measurement as a function of time, liquid nitrogen having been added to the stack in the initial step according to the third embodiment example.

In Example 3 the liquid nitrogen treatment was carried out on a stack covered with a plastic foil which had already begun to heat. FIG. 4 represents the temperatures of the various sections of the stack as a function of time. The nitrogen addition time is also marked in FIG. 4. It appears from the figure, that the addition of liquid nitrogen first produced a strong temperature reduction at the feeding point (−31, ° C.), however the temperature was soon balanced in the whole stack below the initial level. The treatment produced an evenly sinking temperature evolution after the strong initial sinking, which went on until the end of the measuring.

Consequently, the observations indicate that the treatment of an uncovered stack is suited for a temporary cooling of the stack, e.g. at a stack fire risk, whereas the treatment of a covered stack stabilizes the temperature or makes it sink slightly and thus is suitable for the conservation of the stack e.g. for arranging peat delivery.

With the above examples one has been able to demonstrate that the invention functions well, i.e. that by inserting liquid or gaseous inert protective gas into the stack, by which the free air in the stack is displaced, the self-heating taking place by rick storage of peat and the consequent energy loss and self-ignition of the peat can be prevented.

I claim:

1. A method of preventing the energy loss, self-heating and self-ignition of a peat stack characterized in that inert protective gas is conducted into the stack, by which the air present in the stack is diluted or displaced and the aerobic exothermal reactions of the peat are prevented.

2. A method according to claim 1, characterized in that the inert protective gas is carbon dioxide or nitrogen.

3. A method according to either claim 2 or 3, characterized in that the inert protective gas is in a liquid state, whereby it cools the stack also when being evaporated.

4. A method according to claim 3, characterized in that the inert protective gas in a liquid state is liquid nitrogen.

5. A method according to claims 1 or 2, characterized in that the stack is covered in a gas sealing manner, e.g. with a plastic foil, so that the protective gas remains in the stack for a longer period.

6. A method according to claims 1 or 2, characterized in that the inert protective gas is conducted into the stack before the stack has begun to heat, thus preventing completely the energy losses of the peat.

7. A method according to claim 3, characterized in that the inert protective gas, which preferably is in a liquid state, is conducted into the stack at a stage when the stack has grown hot, whereby great energy losses and/or a stack fire are prevented.

8. A method according to claims 1 or 2, characterized in that the inert protective gas is conducted into the stack through several points evenly distributed over the stack, preferably through one or several perforated tubes.

9. A method according to claim 3, characterized in that the stack is covered in a gas sealing manner, e.g. with a plastic foil, so that the protective gas remains in the stack for a longer period.

10. A method according to claim 3, characterized in that the inert protective gas is conducted into the stack before the stack has begun to heat, thus preventing completely the energy losses of the peat.

11. A method according to claim 5, characterized in that the inert protective gas is conducted into the stack before the stack has begun to heat, thus preventing completely the energy losses of the peat.

12. A method according to claims 1 or 2, characterized in that the inert protective gas, which preferably is in a liquid state, is conducted into the stack at a stage when the stack has grown hot, whereby great energy losses and/or a stack fire are prevented.

13. A method for preventing energy loss, self-heating and self-ignition within a peat stack, said method cahracterized in that:

an inert, protective gas selected from between carbon dioxide and nitrogen is conducted into the stack before said stack has begun to heat, by which the air present in the stack is diluted or displaced and any aerobic exothermal reactions within the peat are thus prevented; and said stack is covered in a gas-sealing manner to increase the period during which the protective gas may be retained with the stack.

14. A method for preventing energy loss, self-heating and self-ignition of a peat stack, said method characterized in that:

liquid nitrogen gas is conducted into said stack at a stage when the temperature of the stack is increased so as to lower the temperature of the stack upon evaporation of said gas and by which the air present within the stack is diluted or displaced and any aerobic exothermal reactions of the peat are prevented; and said stack is covered in a gas-sealing manner to increase the period during which the protective gas may be retained within the stack.

* * * * *